US012163749B2

(12) United States Patent
Moretti

(10) Patent No.: US 12,163,749 B2
(45) Date of Patent: Dec. 10, 2024

(54) GUN BARREL ASSEMBLY

(71) Applicant: BENELLI ARMI S.P.A, Urbino (IT)

(72) Inventor: Luigi Moretti, Collebeato (IT)

(73) Assignee: BENELLI ARMI S.P.A., Pesaro Urbino (IT)

( * ) Notice: Subject to any disclaimer, the term of this patent is extended or adjusted under 35 U.S.C. 154(b) by 44 days.

(21) Appl. No.: 17/984,578

(22) Filed: Nov. 10, 2022

(65) Prior Publication Data

US 2023/0152053 A1 May 18, 2023

(30) Foreign Application Priority Data

Nov. 11, 2021 (IT) ..... 102021000028739

(51) Int. Cl.
*F41A 21/16* (2006.01)

(52) U.S. Cl.
CPC ..... *F41A 21/16* (2013.01)

(58) Field of Classification Search
CPC ..... F41A 21/40; F41A 21/16
See application file for complete search history.

(56) References Cited

U.S. PATENT DOCUMENTS 833,484 A * 10/1906 Robedee ..... F41A 21/40 42/79
1,773,260 A * 8/1930 Cutts ..... F41A 21/40 89/14.3
1,944,883 A * 1/1934 Gerlich ..... F41A 21/16 89/14.05
2,288,604 A * 7/1942 Born ..... F42B 14/02 102/514
2,453,121 A * 11/1948 Cutts ..... F41A 21/40 89/14.3
2,658,298 A * 11/1953 Oberfell ..... F41A 21/40 42/79
4,058,925 A * 11/1977 Linde ..... F41A 21/40 42/79
4,467,546 A 8/1984 Beretta
4,527,348 A * 7/1985 Brennan ..... F41A 21/28 89/14.05
5,155,291 A 10/1992 Dabrowski
6,289,620 B1 9/2001 Doria
11,022,394 B1 6/2021 Kedairy
(Continued)

FOREIGN PATENT DOCUMENTS

CN 109141107 1/2019
DE 102014014401 4/2016
(Continued)

*Primary Examiner* — Derrick R Morgan
(74) *Attorney, Agent, or Firm* — DUANE MORRIS LLP; Gregory M. Lefkowitz

(57) ABSTRACT

A smooth-bore barrel assembly including a first segment that extends downstream of a powder chamber, a bore followed by a segment having an increased diameter, and a final choke constituted by a first final portion and by a second final portion; the barrel is characterized in that the first segment has a divergent-convergent configuration, constituted by a divergent portion and by a convergent portion, or a solely convergent or solely divergent configuration. Advantageously, the barrel assembly can be provided in a modular form and includes three basic components: a barrel body, an extension, an inner choke member and/or an outer choke member.

12 Claims, 8 Drawing Sheets

(56) References Cited

U.S. PATENT DOCUMENTS

| | | | | |
|---|---|---|---|---|
| 11,473,883 | B1 * | 10/2022 | Sooter | F41A 21/18 |
| 2005/0108916 | A1 * | 5/2005 | Keeney | F41A 21/02<br>42/76.02 |

FOREIGN PATENT DOCUMENTS

| | | | | |
|---|---|---|---|---|
| GB | 191404510 | | 6/1914 | |
| RU | 2746003 | | 4/2021 | |
| WO | 2012137120 | | 10/2012 | |
| WO | WO-2012137120 | A2 * | 10/2012 | F41A 21/16 |

* cited by examiner

GUN BARREL ASSEMBLY

The present invention relates to a gun barrel assembly.

More particularly, the present invention relates to a smoothbore barrel for long-barreled firearms designed to shoot shotshells.

Numerous and varied configurations of the barrel, designed to improve the performance of the firearm from a technical standpoint, are known.

The desirable features are numerous and often conflicting.

For example, a desirable feature is a higher shot speed at any distance comprised between the muzzle and the range, which would offer the advantage of reducing anticipation and of aiming directly at the target.

Another desirable feature is greater penetration energy, which offers the advantage of increasing the arresting power.

A further desirable feature is a longer range, which offers the advantage of increasing the useful firing distance.

Another desirable feature is an optimal ballistic performance regardless of the ammunition used.

A further desirable feature is to have no constraints on the type of choke with respect to the cartridges that can be used.

A further desirable feature is to reduce manufacturing limitations, due to the relationship between the material and the choke ratio, currently found in standard barrels.

Another desirable feature is the possibility of reducing the pressure variation at barrel exit, with the advantage of reducing noise on firing.

A further desirable feature is a reduced recoiling force.

Some of the above features have been obtained, in a limited way, by prior art barrel assemblies.

For example, Italian patent IT1405143 discloses a barrel assembly with a constant bore diameter of various sizes:

- a bore diameter D1 corresponds to a unified gauge (standard conical portion between chamber and bore);
- a bore diameter D1' that is out of gauge, with D1'=D1+0.3 mm (reduced conical portion between chamber and bore);
- a bore diameter D1" that is out of gauge (e.g., from 20.3 mm for 12-gauge), and in particular is equal to the minimum diameter of the cartridge chamber 2 (no conical portion between chamber and bore);
- an expansion chamber D4 between the bore and the barrel muzzle with a diameter of +0.3/1 mm, beyond the bore diameter.

U.S. Pat. No. 5,155,291A discloses a barrel that allows a prior opening of the shot pattern by means of a divergent segment in the end part.

The web page https://www.mossberg.com/category/series/835-ulti-mag/describes a 12-gauge barrel with a 10-gauge bore which would allow for uniform shot patterns, but with no mention of speed.

U.S. Pat. No. 6,289,620B1 discloses the use of multiple conical portions to minimize recoiling force, without altering shot exit speed. The document explains that 18.4 mm bore diameters ensure speed and arresting power, while 18.8-18.9 mm diameters are said to ensure less recoiling force but also a lower bullet exit speed. Multiple conical portions should combine the advantages of both solutions.

The web page https://www.beretta.com/en/691/describes barrel assemblies that should ensure higher shot pattern density with high penetration, a smaller muzzle rise and, finally, a fast and accurate second shot.

DE102014014401A1 discloses a rifled barrel having an entry region which merges into a front barrel part ending in a muzzle region; the region between the entry region and the muzzle region forms an acceleration channel which has a diameter which is enlarged in relation to the diameters of the entry region and the muzzle region.

U.S. Pat. No. 11,022,394B1 discloses a multi-bore rifled barrel having a proximal chamber end, a distal muzzle end, and an internal bore bounded by a bore wall where the internal bore has a cartridge chamber at the proximal chamber end of the barrel, a first rifled bore section distal to the cartridge chamber, a second rifled bore section at the distal muzzle end of the barrel, and a reducing section distal to the first rifled bore section and connecting the first rifled bore section and the second rifled bore section.

U.S. Pat. No. 4,058,925 discloses a pattern control system for a shotgun in which choke attachments are detachably mounted on the muzzle end of the shotgun barrel and the barrel bore and progressively reduced choke constrictions, either in the bore and the choke attachments or in the attachments alone, are formed at the same time in order to eliminate tolerance buildup between the choke attachment bore constrictions and the barrel bore.

Each of the above mentioned systems, however, offers only a limited number of desirable features; none of the prior art barrels is capable of combining all the features into a single assembly.

The aim of the present invention is to provide a new gun barrel assembly that overcomes the drawbacks of the cited prior art.

Within the scope of this aim, an object of the invention is to provide a gun barrel assembly that allows to obtain a higher shot speed at any distance comprised between the muzzle and the range, offering the advantage of reducing anticipation and of aiming directly at the target.

An object of the invention is to provide a gun barrel assembly that allows to have a higher penetration energy, with the advantage of increasing the arresting power.

A further object of the invention is to provide a gun barrel assembly that allows to have a greater range and thus increase the useful firing distance.

A further object of the invention is to provide a gun barrel assembly that offers optimal ballistic performance with any ammunition.

A further object of the invention is to provide a gun barrel assembly that offers the possibility to have no constraints on the type of choke, with respect to the cartridges that can be used, and to reduce manufacturing limitations due to the relationship between the material and the choke ratio.

A further object of the invention is to provide a gun barrel assembly that reduces the pressure variation at barrel exit, with the advantage of reducing noise on firing.

A further object of the invention is to provide a gun barrel assembly that reduces the recoiling force.

A further object of the invention is to provide the user with a barrel assembly with a length that is variable depending on the type of sports or hunting use.

A further object of the invention is to reduce the production, management and purchase costs of barrels.

A further object of the present invention is to provide an assembly which by virtue of its particular constructive characteristics is capable of giving the greatest assurances of reliability and safety in use.

This aim, these objects and others which will become better apparent hereinafter are achieved by a gun barrel assembly, as claimed in the accompanying claims.

Further characteristics and advantages will become better apparent from the description of preferred but not exclusive embodiments of the invention, illustrated by way of non-limiting example in the accompanying drawings, wherein.

Figure 1:
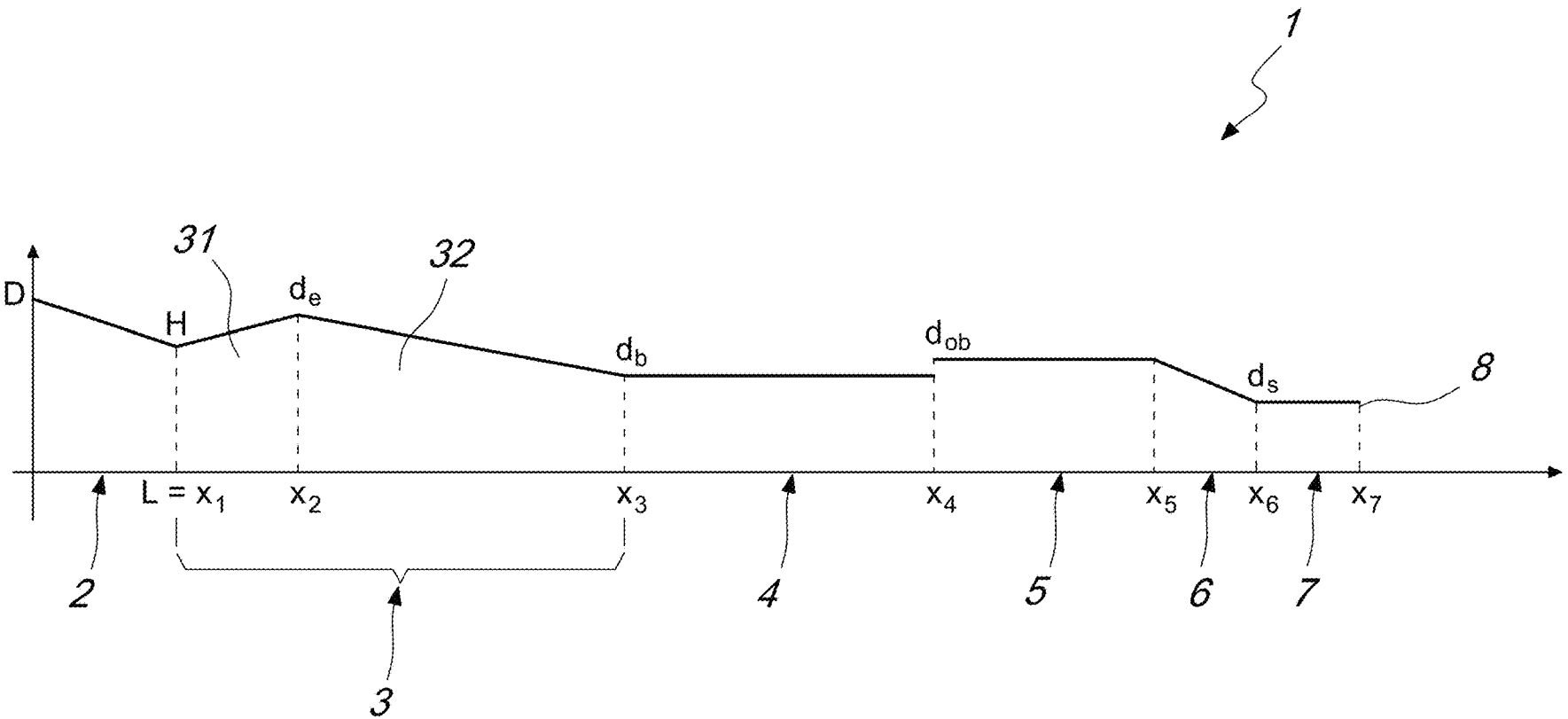
FIG. 1 is a schematic sectional view of the barrel according to the present invention.

With reference to the cited figures, the gun barrel assembly according to the invention, generally designated by the reference numeral 1, has a first segment, designated by the reference numeral 3, which is extended after a chamber 2, and has a divergent-convergent configuration, constituted by a divergent portion 31 and by a convergent portion 32, or with a solely convergent or solely divergent configuration.

FIG. 1 shows an embodiment having the configuration with a divergent portion 31 and a convergent portion 32.

The barrel 1 includes a bore 4, followed by a segment having an increased diameter 5, which may have a constant configuration, as in FIG. 1, or a divergent configuration, and an end choke constituted by a first end portion 6 and a second end portion 7.

The profile of the barrel according to the present invention is defined by means of a mathematical formula that describes the optimized internal profile along the entire length of the barrel, from the chamber 2 to the muzzle 8, and contains only the chamber length and diameters defined by the CIP standard (D, H and L) and the parameters ($\varepsilon_0$, $\varepsilon_1$, $\beta_0$, $\beta_1$, $\gamma_0$, $\gamma_1$, $\rho$).

The formula, as shown below with reference to FIG. 1, does not make the diameters of the various segment explicit and is applicable to all smoothbore calibers.

$$f(x)=\begin{cases} D-\frac{x}{L}\cdot(D-H) & 0\le x\le L \\ \varepsilon_0 H\left(e^0-\frac{x-L}{(x_2-L)}(e^0-\beta_1)\right) & L<x\le x_2 \\ \varepsilon_1 H\left(\beta_1^{\varepsilon_0}-\frac{x-x_2}{(x_3-x_2)}(\beta_1^{E_0}-\beta_0)\right) & x_2<x\le x_3 \\ (\varepsilon_1\beta_0+\varepsilon_0\beta_1-\varepsilon_0\varepsilon_1\beta_1)H & x_3<x\le x_4 \\ (\varepsilon_1\gamma_0+\gamma_1\varepsilon_0-\varepsilon_0\varepsilon_1\gamma_1)H & x_4<x\le x_5 \\ (\varepsilon_1\gamma_0+\gamma_1\varepsilon_0-\varepsilon_0\varepsilon_1\gamma_1)H-\frac{x-x_S}{x_6-x_S}\cdot((\varepsilon_1\gamma_0+\gamma_1\varepsilon_0-\varepsilon_0\varepsilon_1\gamma_1)H-\rho(\varepsilon_1\beta_0+\varepsilon_0\beta_1-\varepsilon_0\varepsilon_1\beta_1)H) & x_5<x\le x_6 \\ p(\varepsilon_1\beta_0+\varepsilon_0\beta_1-\varepsilon_0\varepsilon_1\beta_1)H & x_6<x\le x_7 \end{cases}$$

According to the C.I.P. standard, the parameters related to the cartridge chamber are defined as follows:

D: diameter at chamber mouth;

H: diameter at end of chamber;

L: chamber length.

The other parameters mentioned in the above cited formula are defined as follows:

- $\varepsilon_0$: topological divergence coefficient; it can only assume the values "0" and "1";
- $\varepsilon_1$: topological convergence coefficient; it can only assume the values "0" and "1";
- $\beta_0$: convergence coefficient; this is the ratio between the bore diameter ($d_b$) and the diameter at end of chamber (H) (convergent and divergent-convergent case);
- $\beta_1$: divergence coefficient; this is the ratio between the bore diameter ($d_b$) and the diameter at end of chamber (H) (divergent case); $\beta_1$ is greater than $\beta_0$;
- $\gamma_0$: expansion coefficient; this is the ratio between the diameter of the segment having an increased diameter ($d_{ob}$) and the diameter at end of chamber (H) (convergent and divergent-convergent case);
- $\gamma_1$: expansion coefficient; this is the ratio between the diameter of the segment having an increased diameter ($d_{ob}$) and the diameter at end of chamber (H) (divergent case); $\gamma_1$ is greater than $\gamma_0$;
- $\rho$: choke coefficient; this is the ratio between the outlet diameter and the bore diameter $\beta_0$ or $\beta_1$.

Figure 2:
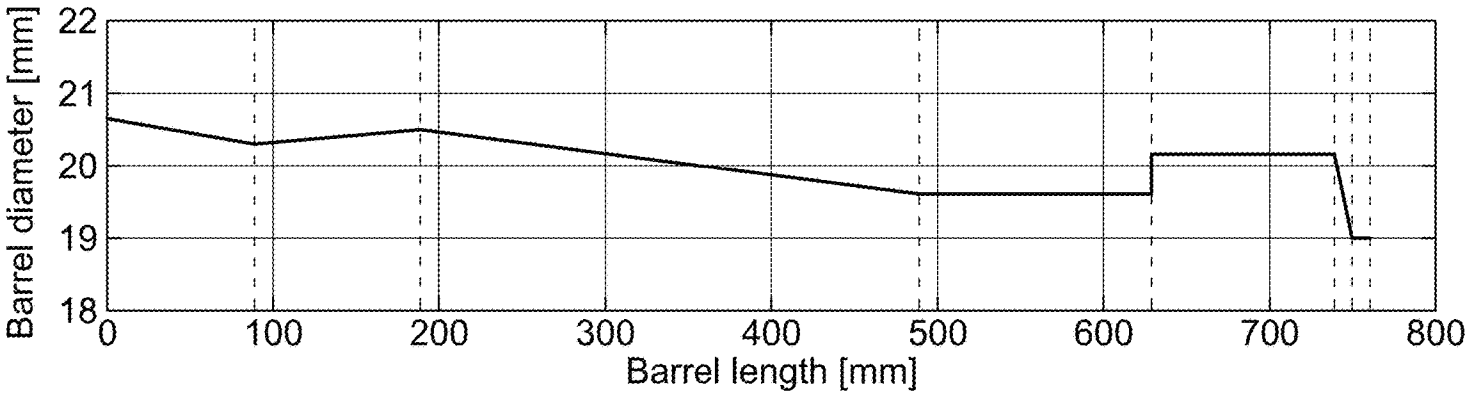
FIG. 2 is a schematic view of an example of the proportional dimensions of a barrel according to the invention configured with a divergent-convergent profile.
Figure 3:
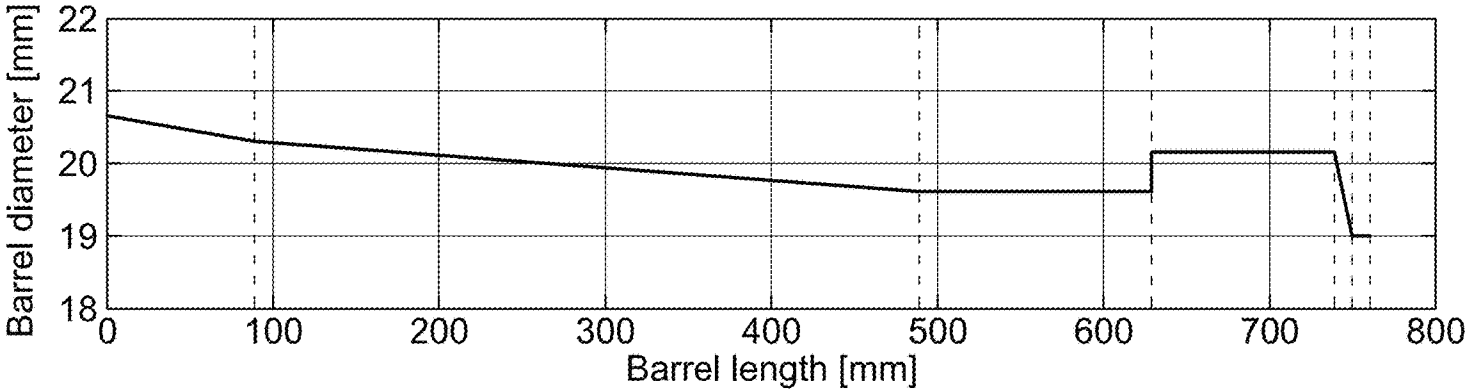
FIG. 3 is a schematic view of an example of the proportional dimensions of a barrel according to the invention configured with a convergent profile.
Figure 4:
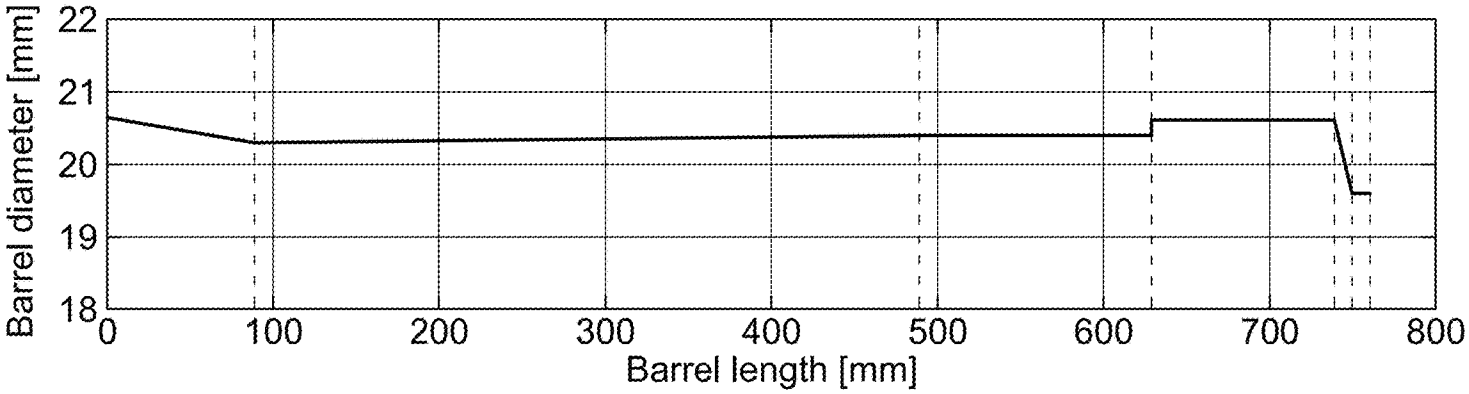
FIG. 4 is a schematic view of an example of the proportional dimensions of a barrel according to the invention configured with a divergent profile.

The internal profile of the barrel 1, according to the present invention, may assume three different shapes as the parameters $\varepsilon_0$, $\varepsilon_1$ vary, as exemplified in FIGS. 2-4.

FIG. 2 shows a profile with divergent-convergent configuration, in which $\varepsilon_0=1$, $\varepsilon_1=1$, $\chi_1\neq\chi_2\neq\chi_3$.

FIG. 3 shows a profile with convergent configuration, in which $\varepsilon_0=0$, $\varepsilon_1=1$, $\chi_1=\chi_2$.

FIG. 4 shows a profile with divergent configuration, in which $\varepsilon_0=1$, $\varepsilon_1=0$, $\chi_2=\chi_3$.

Advantageously, the above formula is valid for all smoothbore calibers.

The barrel assembly according to the present invention allows to obtain all the advantageous features indicated hereinafter with great advantage over barrels of the background art, which are each capable of providing only a portion of the desirable characteristics.

The barrel assembly according to the present invention allows a higher shot speed at any distance comprised between the muzzle and the range. This ensures the possibility to reduce the anticipation and aim directly at the target.

A further characteristic of the present barrel assembly is constituted by higher penetration energy, with the advantage of increased arresting power.

A further characteristic of the present barrel assembly is the increased range, which allows for an increase in the useful firing distance.

A further characteristic of the present barrel assembly is the improved ballistic performance, with both shot cartridges (lead and "lead free" materials) and ball cartridges, offering the advantage of increased ballistic performance regardless of the ammunition used.

An additional characteristic of the present barrel assembly is constituted by the fact that it eliminates the choke constraints for "lead free" cartridges, which in traditional firearms are due to the standard chokes made of ordinary steel, which do not allow going beyond 3-star chokes. The new profile of the barrel assembly according to the present invention allows to overcome this limitation and have different shot patterns with different types of choke; for example, shot patterns corresponding to full (1-star) chokes with a standard 3-star choke.

The innovative spread produced by the new barrel profile according to the present invention offers the advantage of reducing manufacturing limitations, i.e., the relationship between the material and the choke ratio, that are typical of traditional standard barrels.

A further characteristic of the present barrel assembly resides in that it reduces the pressure variation at barrel exit, since the new internal profile allows to increase the speed in the end part of the barrel, resulting in reduced local pressure. This offers the advantage of producing less noise on firing.

A further advantageous characteristic of the present barrel assembly is the reduced recoiling force.

Figure 5:
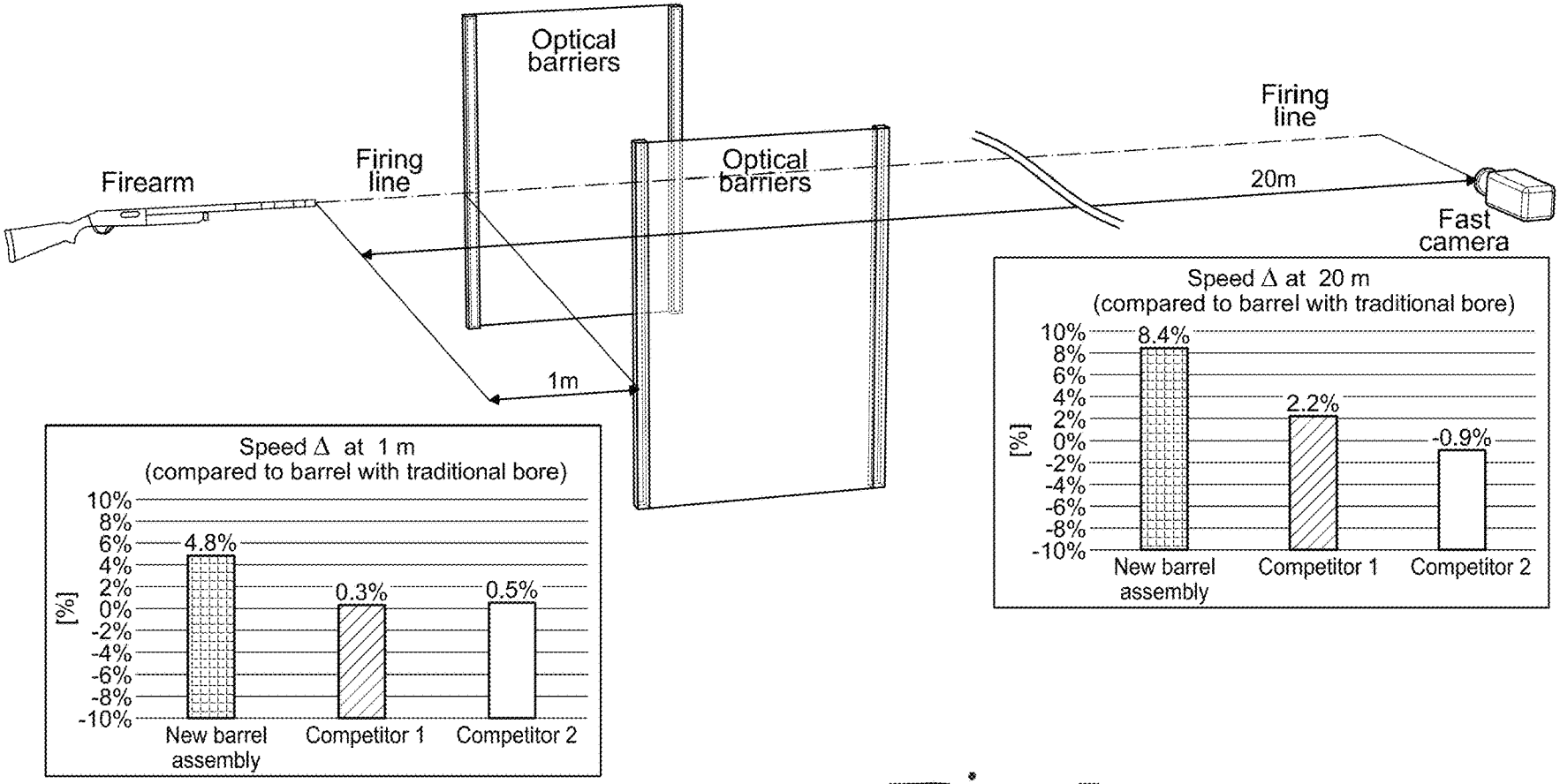
FIGS. 5 and 6 are schematic views of test methods and of the results obtained with the barrel according to the present invention compared with traditional systems.
Figure 6:
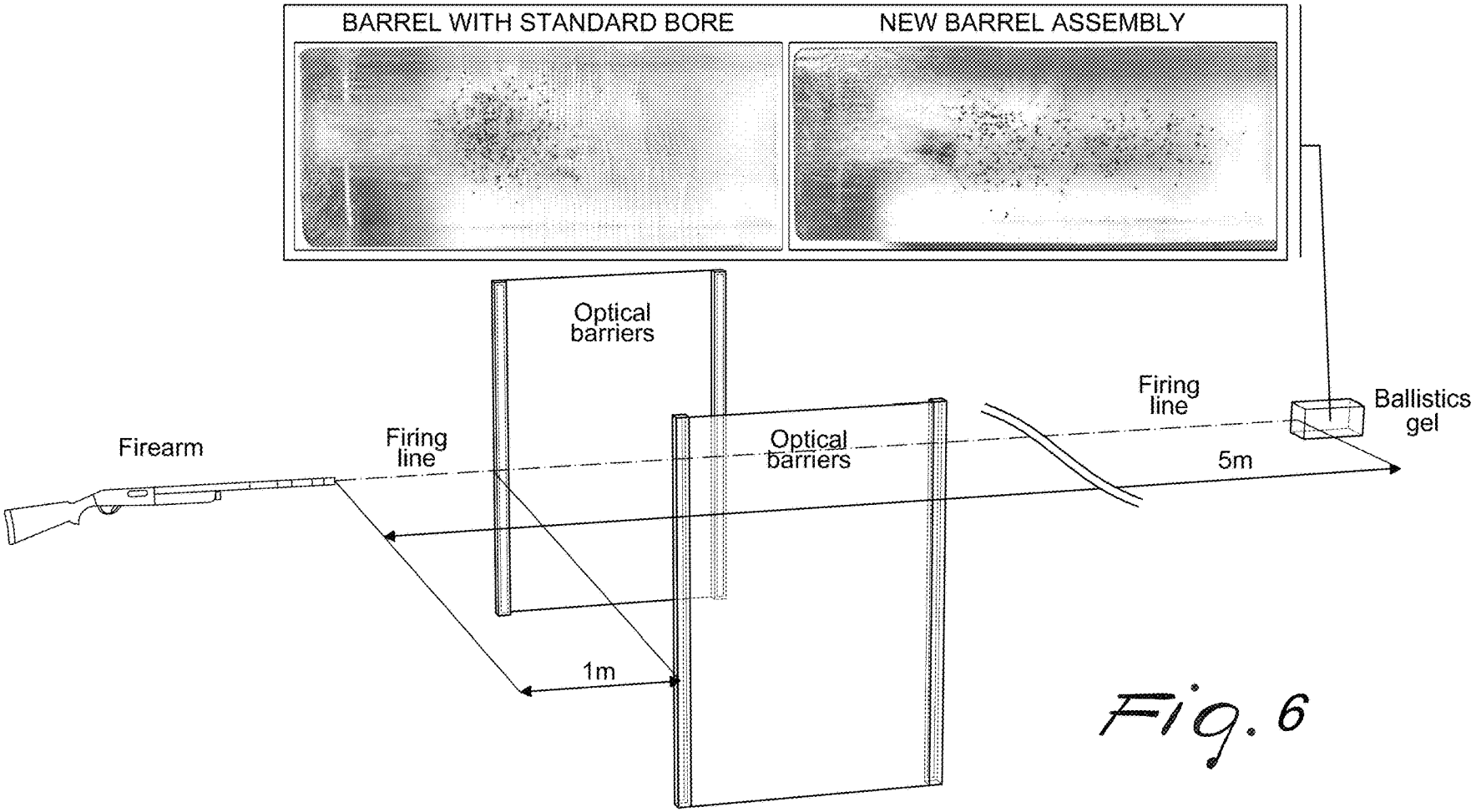

FIGS. 5 and 6 schematically show the test methods and the results obtained with the barrel assembly according to the present invention, compared with traditional systems.

Advantageously, the barrel assembly according to the present invention can be made in modular form, as described below.

Figure 7:
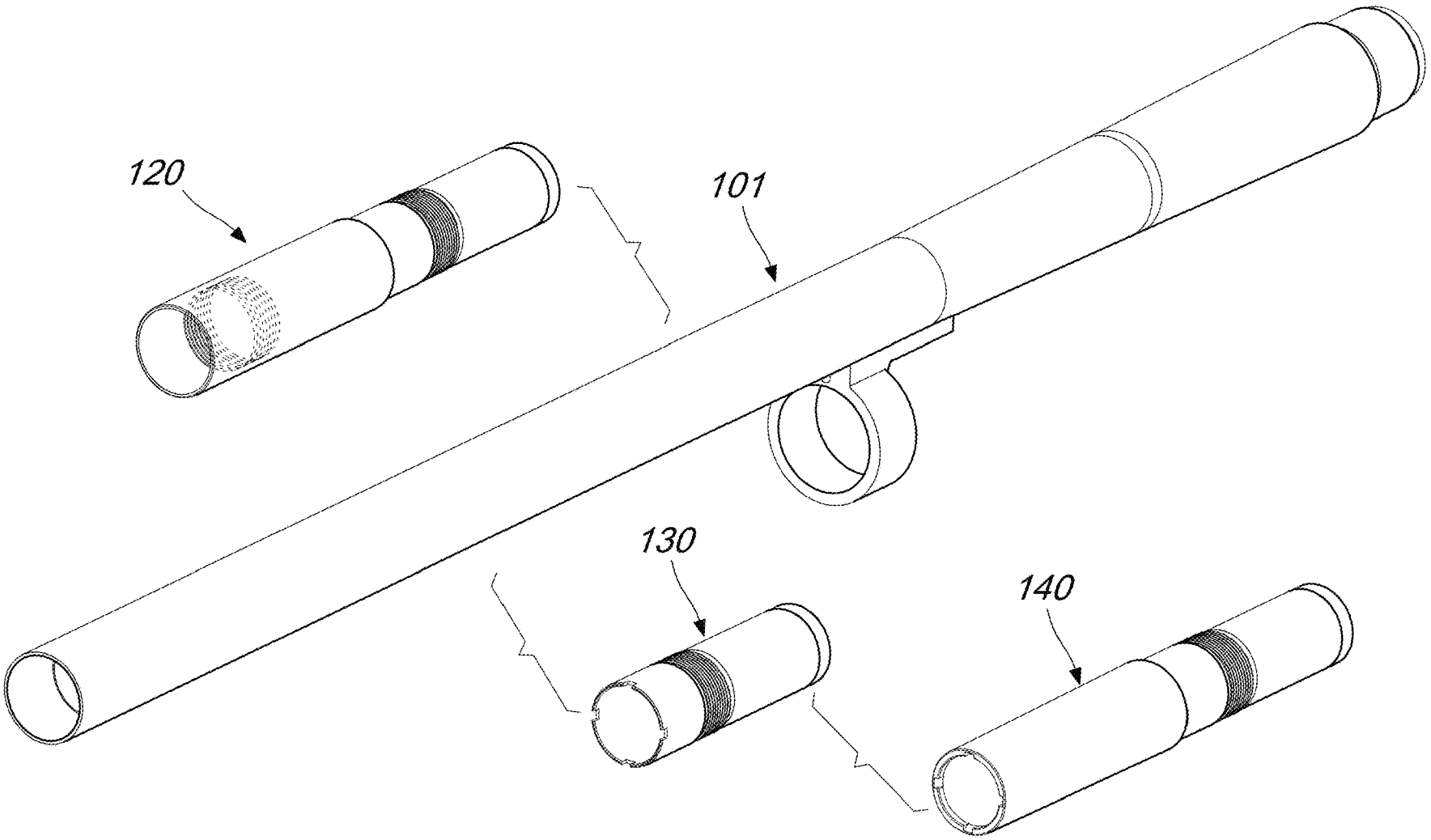
FIG. 7 is an exploded view of an embodiment of the barrel, constituted by three components.

According to an aspect of the present invention, the adjustable barrel assembly is constituted by three basic components: a barrel body 101, an extension 120, an inner choke member 130, and/or an outer choke member 140, shown schematically in FIG. 7.

According to an aspect of the invention, the barrel assembly is provided with a configuration without a choke member, i.e., with a choke provided in the barrel body itself.

In this embodiment, the barrel assembly is not adapted to allow adjustment, due to the absence of a muzzle thread, but is designed to provide the shooter with the best ballistic performance/penetration force, while keeping the barrel length constant.

The internal geometry of the barrel is defined by acting on the following sections:

1. length of the chamber/bore conical blending portion;
2. bore diameter, which can be constant, increasing, decreasing or "combined" (e.g., increasing+constant+decreasing);
3. length and type of fixed choke, which can be constant, increasing, decreasing or "combined", e.g.: increasing+constant+decreasing.

Figure 8:
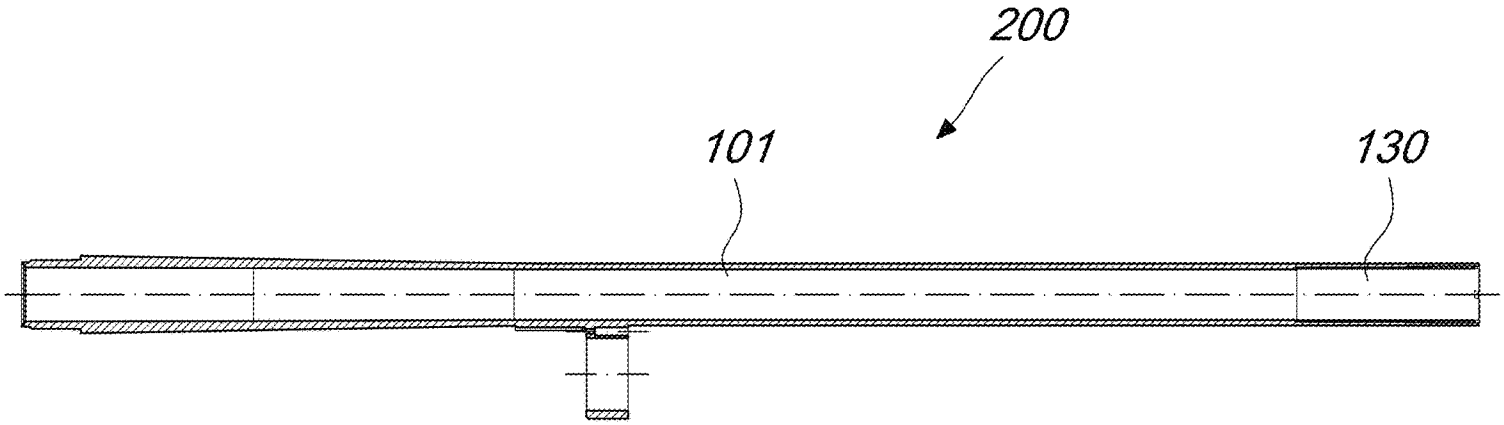
FIG. 8 is a sectional view of a barrel provided with a configuration having an inner choke member.

According to a further aspect of the invention, the barrel assembly is provided with a configuration having an inner choke member; this barrel, designated by the reference numeral 200, is shown in FIG. 8.

In this case, the barrel 200 is adapted to allow adjustment by means of a muzzle thread.

This configuration includes two components, the barrel 101 and the inner choke member 130, and allows to reach a minimum barrel length.

Considering that the inside diameter of each component can be provided in four ways (constant, increasing, decreasing or combined), it follows that the total number of configurations that can be provided with this type of barrel+inner choke is sixteen, using four barrels and four inner chokes, for a total of eight components:

| ID | BARREL PROFILE | INNER CHOKE PROFILE |
|---|---|---|
| 1 | CONSTANT | CONSTANT |
| 2 | | INCREASING |
| 3 | | DECREASING |
| 4 | | COMBINED |
| 5 | INCREASING | CONSTANT |
| 6 | | INCREASING |
| 7 | | DECREASING |
| 8 | | COMBINED |
| 9 | DECREASING | CONSTANT |
| 10 | | INCREASING |
| 11 | | DECREASING |
| 12 | | COMBINED |
| 13 | COMBINED | CONSTANT |
| 14 | | INCREASING |
| 15 | | DECREASING |
| 16 | | COMBINED |

Figure 10:
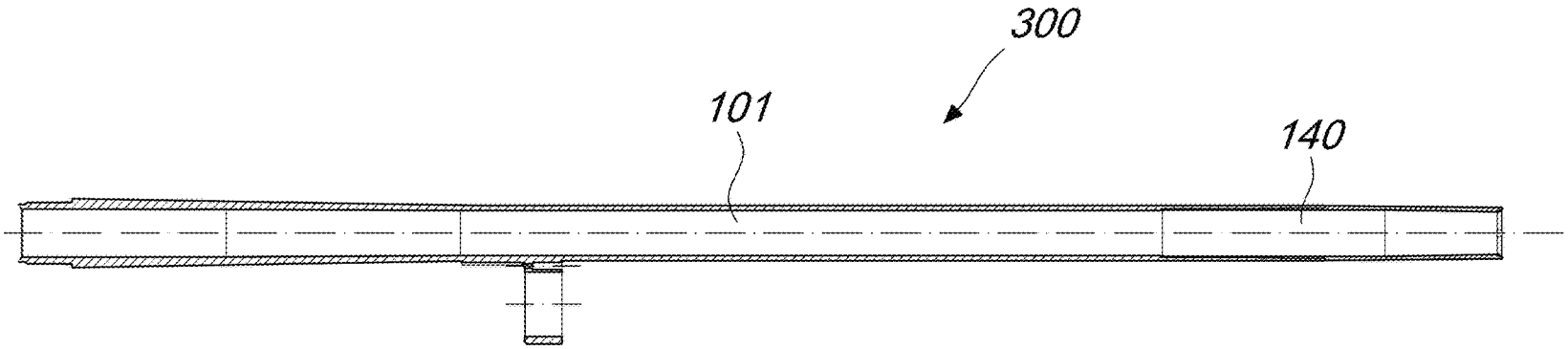
FIG. 10 is a sectional view of a barrel provided with a configuration having an inner choke member.

According to a further aspect of the invention, the barrel assembly is provided with a configuration having an outer choke member; this barrel assembly, designated by the reference numeral 300, is shown in FIG. 10.

This barrel assembly is designed to allow adjustment, by means of the muzzle thread, and is the same one as in the previous example.

This configuration includes two components: the barrel 101 and the outer choke 140, allowing to reach a medium barrel length, referenced here as "MEDIUM Type 1".

Since the inside diameter of each component can be provided in four ways (constant, increasing, divergent or combined), it follows that the total number of configurations, that can be provided with this type of barrel with outer choke, is sixteen, using four barrels and four outer chokes, for a total of eight components.

| ID | BARREL PROFILE | OUTER CHOKE PROFILE | BARREL LENGTH |
|---|---|---|---|
| 1 | CONSTANT | CONSTANT | MEDIUM |
| 2 | | INCREASING | Type 1 |
| 3 | | DECREASING | |
| 4 | | COMBINED | |
| 5 | INCREASING | CONSTANT | |
| 6 | | INCREASING | |
| 7 | | DECREASING | |
| 8 | | COMBINED | |
| 9 | DECREASING | CONSTANT | |
| 10 | | INCREASING | |
| 11 | | DECREASING | |
| 12 | | COMBINED | |
| 13 | COMBINED | CONSTANT | |
| 14 | | INCREASING | |
| 15 | | DECREASING | |
| 16 | | COMBINED | |

Figure 9:
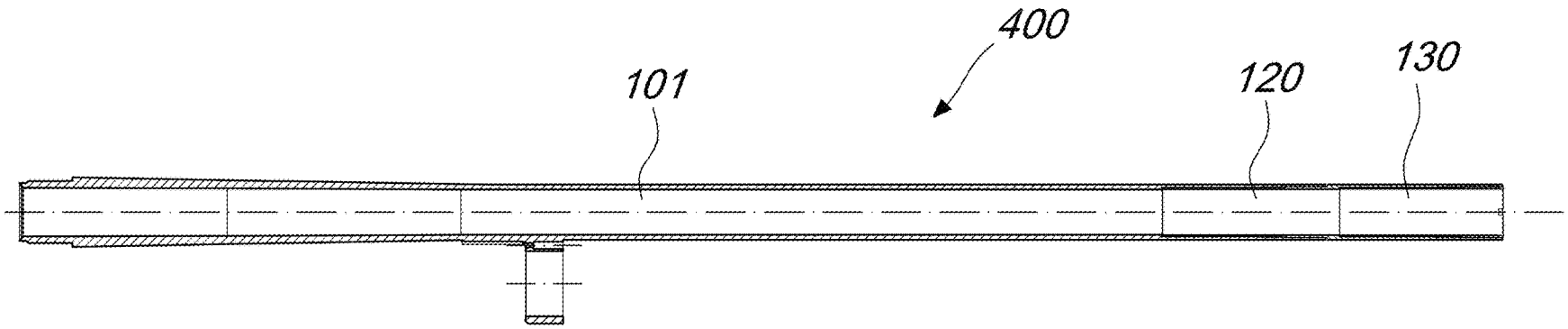
FIG. 9 is a sectional view of a barrel provided with a configuration having an extension and an inner choke member.

According to a further aspect of the invention, the barrel assembly is provided with a configuration having an extension and an inner choke member; this barrel assembly, designated by the reference numeral 400, is shown in FIG. 9.

In this case, the barrel assembly is adapted to be adjustable, by means of the muzzle thread, and is the same one as in the previous example.

This configuration includes three components: the barrel 101, the extension 120, and the inner choke 130, and allows to reach a medium barrel length, referenced here as "MEDIUM Type 2".

Since the inside diameter of each component can be provided in four ways (constant, increasing, decreasing or "combined"), it follows that the total number of configurations that can be provided with this type of assembly, barrel+extension+inner choke, is sixty-four using a total of twelve components (four barrels, four extensions and four inner chokes).

| ID | BARREL PROFILE | EXTENSION PROFILE | INNER CHOKE PROFILE | BARREL LENGTH |
|---|---|---|---|---|
| 1 | CONSTANT | CONSTANT | CONSTANT | MEDIUM Type 2 |
| 2 | | | INCREASING | |
| 3 | | | DECREASING | |
| 4 | | | COMBINED | |
| 5 | | INCREASING | CONSTANT | |
| 6 | | | INCREASING | |
| 7 | | | DECREASING | |
| 8 | | | COMBINED | |
| 9 | | DECREASING | CONSTANT | |
| 10 | | | INCREASING | |
| 11 | | | DECREASING | |
| 12 | | | COMBINED | |
| 13 | | COMBINED | CONSTANT | |
| 14 | | | INCREASING | |
| 15 | | | DECREASING | |
| 16 | | | COMBINED | |
| 17 | INCREASING | CONSTANT | CONSTANT | |
| 18 | | | INCREASING | |
| 19 | | | DECREASING | |
| 20 | | | COMBINED | |
| 21 | | INCREASING | CONSTANT | |
| 22 | | | INCREASING | |
| 23 | | | DECREASING | |
| 24 | | | COMBINED | |
| 25 | | DECREASING | CONSTANT | |
| 26 | | | INCREASING | |
| 27 | | | DECREASING | |
| 28 | | | COMBINED | |
| 29 | | COMBINED | CONSTANT | |
| 30 | | | INCREASING | |
| 31 | | | DECREASING | |
| 32 | | | COMBINED | |
| 33 | DECREASING | CONSTANT | CONSTANT | |
| 34 | | | INCREASING | |
| 35 | | | DECREASING | |
| 36 | | | COMBINED | |
| 37 | | INCREASING | CONSTANT | |
| 38 | | | INCREASING | |
| 39 | | | DECREASING | |
| 40 | | | COMBINED | |
| 41 | | DECREASING | CONSTANT | |
| 42 | | | INCREASING | |
| 43 | | | DECREASING | |
| 44 | | | COMBINED | |
| 45 | | COMBINED | CONSTANT | |
| 46 | | | INCREASING | |
| 47 | | | DECREASING | |
| 48 | | | COMBINED | |
| 49 | COMBINED | CONSTANT | CONSTANT | |
| 50 | | | INCREASING | |
| 51 | | | DECREASING | |
| 52 | | | COMBINED | |
| 53 | | INCREASING | CONSTANT | |
| 54 | | | INCREASING | |
| 55 | | | DECREASING | |
| 56 | | | COMBINED | |
| 57 | | DECREASING | CONSTANT | |
| 58 | | | INCREASING | |
| 59 | | | DECREASING | |

-continued

| ID | BARREL PROFILE | EXTENSION PROFILE | INNER CHOKE PROFILE | BARREL LENGTH |
|---|---|---|---|---|
| 60 | | | COMBINED | |
| 61 | | COMBINED | CONSTANT | |
| 62 | | | INCREASING | |
| 63 | | | DECREASING | |
| 64 | | | COMBINED | |

By disassembling the extension 120 it is possible to reduce the barrel length from "MEDIUM Type 2" to "MINIMUM", which corresponds to the previous configuration, designated by the reference numeral 200, which allows to have sixteen more configurations.

In summary, with twelve components (four barrels, four extensions and four inner chokes) it is possible to have:

sixty-four configurations with "MEDIUM Type 2" barrel length sixteen configurations with "MINIMUM" barrel length.

Figure 11:
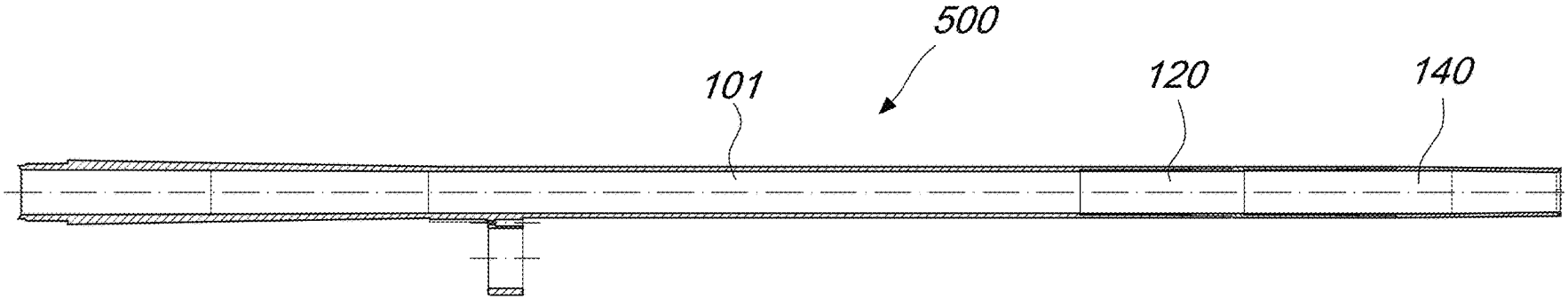
FIG. 11 is a sectional view of a barrel provided with a configuration having an extension and an outer choke member.

According to a further aspect of the invention, the barrel assembly is provided with a configuration having an extension and an outer choke member; this barrel assembly, designated by the reference numeral 500, is shown in FIG. 11.

In this case, the barrel assembly is designed to be adjustable, by means of the muzzle thread, and is the same one as in the previous example.

This configuration has three components: the barrel 101, the extension 120 and the outer choke 140, allowing to reach the maximum barrel length.

Considering that the inside diameter of each component can be provided in four ways (constant, increasing, decreasing or combined), it follows that the total number of configurations that can be provided with this type of barrel with extension and outer choke is sixty-four, using a total of twelve components (four barrels, four extensions and four outer chokes).

| ID | BARREL PROFILE | EXTENSION PROFILE | OUTER CHOKE PROFILE | BARREL LENGTH |
|---|---|---|---|---|
| 1 | CONSTANT | CONSTANT | CONSTANT | MAXIMUM |
| 2 | | | INCREASING | |
| 3 | | | DECREASING | |
| 4 | | | COMBINED | |
| 5 | | INCREASING | CONSTANT | |
| 6 | | | INCREASING | |
| 7 | | | DECREASING | |
| 8 | | | COMBINED | |
| 9 | | DECREASING | CONSTANT | |
| 10 | | | INCREASING | |
| 11 | | | DECREASING | |
| 12 | | | COMBINED | |
| 13 | | COMBINED | CONSTANT | |
| 14 | | | INCREASING | |
| 15 | | | DECREASING | |
| 16 | | | COMBINED | |
| 17 | INCREASING | CONSTANT | CONSTANT | |
| 18 | | | INCREASING | |
| 19 | | | DECREASING | |
| 20 | | | COMBINED | |
| 21 | | INCREASING | CONSTANT | |
| 22 | | | INCREASING | |
| 23 | | | DECREASING | |
| 24 | | | COMBINED | |
| 25 | | DECREASING | CONSTANT | |
| 26 | | | INCREASING | |
| 27 | | | DECREASING | |
| 28 | | | COMBINED | |
| 29 | | COMBINED | CONSTANT | |

-continued

| ID | BARREL PROFILE | EXTENSION PROFILE | OUTER CHOKE PROFILE | BARREL LENGTH |
|---|---|---|---|---|
| 30 | | | INCREASING | |
| 31 | | | DECREASING | |
| 32 | | | COMBINED | |
| 33 | DECREASING | CONSTANT | CONSTANT | |
| 34 | | | INCREASING | |
| 35 | | | DECREASING | |
| 36 | | | COMBINED | |
| 37 | | INCREASING | CONSTANT | |
| 38 | | | INCREASING | |
| 39 | | | DECREASING | |
| 40 | | | COMBINED | |
| 41 | | DECREASING | CONSTANT | |
| 42 | | | INCREASING | |
| 43 | | | DECREASING | |
| 44 | | | COMBINED | |
| 45 | | COMBINED | CONSTANT | |
| 46 | | | INCREASING | |
| 47 | | | DECREASING | |
| 48 | | | COMBINED | |
| 49 | COMBINED | CONSTANT | CONSTANT | |
| 50 | | | INCREASING | |
| 51 | | | DECREASING | |
| 52 | | | COMBINED | |
| 53 | | INCREASING | CONSTANT | |
| 54 | | | INCREASING | |
| 55 | | | DECREASING | |
| 56 | | | COMBINED | |
| 57 | | DECREASING | CONSTANT | |
| 58 | | | INCREASING | |
| 59 | | | DECREASING | |
| 60 | | | COMBINED | |
| 61 | | COMBINED | CONSTANT | |
| 62 | | | INCREASING | |
| 63 | | | DECREASING | |
| 64 | | | COMBINED | |

Starting from the complete configuration, the replacement of the outer choke 140 with the inner choke 130 allows to reduce the barrel length from maximum to "MEDIUM Type 2", which corresponds to the previous configuration, which allows to have sixty-four configurations more.

Starting from the complete configuration, by disassembling only the central extension 120 it is possible to reduce the barrel length from maximum to "MEDIUM Type 1", which corresponds to the previous configuration, which allows to have sixteen configurations more.

Starting from the complete configuration, by disassembling the extension 120 and replacing the outer choke 140 with the inner choke 130 it is possible to reduce the barrel length from maximum to minimum, which corresponds to the previous configuration, which allows to have sixteen configurations more.

In summary, with sixteen components (four barrels, four extensions, four inner chokes and four outer chokes) it is possible to have:

- sixty-four configurations with maximum barrel length
- sixty-four configurations with "MEDIUM Type 2" barrel length
- sixteen configurations with "MEDIUM Type 1" barrel length
- sixteen configurations with minimum barrel length.

Advantageously, the barrel assembly according to the present invention can be provided monolithically or in a double configuration, according to the teachings of European Patent EP2541187B1.

An important advantage of the double barrel is to make it possible to produce all the standard lengths using the same tube 102, with a considerable manufacturing advantage.

Figure 12:
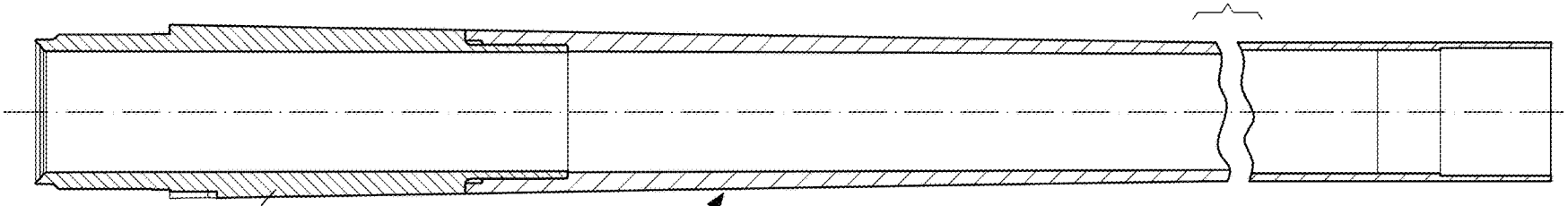
FIG. 12 is a partial sectional view of a double barrel provided with a 3.5" powder chamber.
Figure 13:
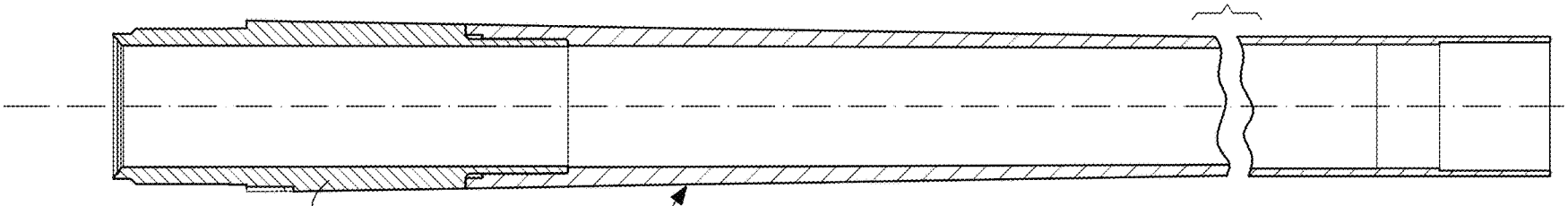
FIG. 13 is a partial sectional view of a double barrel provided with a 3" powder chamber.
Figure 14:
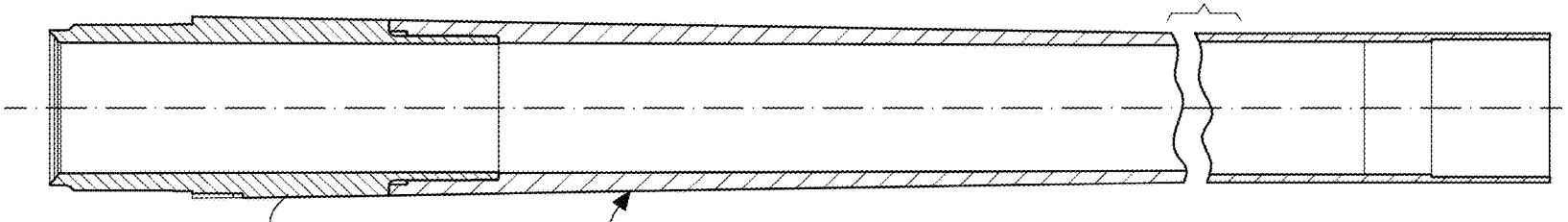
FIG. 14 is a partial sectional view of a double barrel provided with a 2¾" powder chamber.

By way of example, FIGS. 12, 13, 14 respectively show 3.5", 3", 2¾" powder chambers, however, other lengths can also be advantageously used, for example 1.75".

According to a further aspect of the present invention, the present barrel assembly can advantageously be provided with different solutions of aiming members in order to allow easy and quick aiming, without interfering with the added modular members.

The barrel assembly may have a sight holder and a muzzle sight, a rib, made of metal, carbon fiber or other materials, a sight notch, a secondary rib.

In practice it has been found that the invention achieves the intended aim and objects, providing a new gun barrel assembly that ensures a combination of advantageous functional characteristics, confirmed by numerous experimental tests concerning speed measured at twenty meters, shot penetration, and ballistic tests with both shot and ball cartridges.

The new internal profile of the barrel assembly according to the present invention is the result of a fluid dynamics study aimed at maximizing the previously described advantages by considering these aspects:

- the subsonic/transonic/supersonic flow that is present inside the barrel depending on the type of bullet used (e.g., a subsonic flow accelerates in a convergent duct, a supersonic flow accelerates in a divergent duct);
- Bernoulli's theorem and minimization of distributed and localized load losses within the barrel;
- maximization of the barrel bore, far beyond that currently considered/provided by competitors (for a 12 gauge it is approximately 19.6 mm vs. the standard 18.4-18.8 mm);
- maximization of the segment with increased diameter (localized volume increase in the muzzle), well beyond that currently considered/provided by competitors (for a 12 gauge it can exceed 21.3 mm, the maximum value of case no. 3 of Italian patent IT1405143, which does not, however, provide for the initial conical blending portion).

The gun barrel assembly according to the present invention offers a whole series of important advantages, unlike the prior art barrels, none of which is able to provide a combination of all the aforementioned advantages.

The gun barrel assembly according to the present invention allows higher shot speed at any distance comprised between the muzzle and the range, allowing to reduce the anticipation and aim directly at the target.

The barrel according to the invention provides a higher penetration energy, increasing the arresting power.

The barrel according to the invention offers a greater range, increasing the useful firing distance.

The barrel according to the invention offers improved ballistic performance with both shot cartridges (lead and "lead free" materials) and ball cartridges, increasing ballistic performance regardless of the ammunition used.

The barrel according to the invention eliminates current choke constraints for "lead free" cartridges. Currently, with "standard" chokes made of ordinary steel one cannot go beyond 3-star chokes: the new barrel profile allows to overcome this limitation and have shot patterns corresponding to full (1-star) chokes with a standard 3-star choke. This makes it possible to reduce the manufacturing limits (relationship between the material and the choke ratio) currently present in standard barrels thanks to the innovative spread produced by the new barrel profile.

The barrel according to the present invention reduces the pressure variation at barrel exit by virtue of the new internal profile, which allows to increase the speed in the end part of the barrel, with consequent local pressure reduction, reducing noise on firing.

A further advantage of the barrel according to the present invention is constituted by recoil reduction.

The modular construction of the barrel according to the present invention offers the advantage of eliminating or at least considerably reducing the technological constraints that current barrels of the traditional type provided by hammering or boring.

A further advantage of the modular barrel is that of providing the user with a barrel of variable length, depending on the type of sports/hunting use.

A further advantage of the modular barrel is the possibility to reduce barrel production/management and purchase costs.

This application claims the priority of Italian Patent Application No. 102021000028739, filed on Nov. 11, 2021, the subject matter of which is incorporated herein by reference.

The invention claimed is:

1. A gun barrel assembly comprising a first segment that extends downstream of a powder chamber, a bore followed by a second segment having an increased diameter, and a final choke constituted by a first final portion and by a second final portion; said first segment having a divergent-convergent configuration, constituted by a divergent portion and by a convergent portion, wherein an internal profile of said barrel is defined by means of a mathematical formula that describes the internal profile along the entire length of said barrel, from said chamber to said muzzle; said formula containing only the diameters and the length of said chamber, defined by chamber parameters (D, H and L) and by additional parameters ($\varepsilon_0$, $\varepsilon_1$, $\beta_0$, $\beta_1$, $\gamma_0$, $\gamma_1$, $\rho$):

$$f(x)=\begin{cases} D-\frac{x}{L}\cdot(D-H) & 0\le x\le L \\ \varepsilon_0 H\left(e^0-\frac{x-L}{(x_2-L)}(e^0-\beta_1)\right) & L<x\le x_2 \\ \varepsilon_1 H\left(\beta_1^{\varepsilon_0}-\frac{x-x_2}{(x_3-x_2)}(\beta_1^{E_0}-\beta_0)\right) & x_2<x\le x_3 \\ (\varepsilon_1\beta_0+\varepsilon_0\beta_1-\varepsilon_0\varepsilon_1\beta_1)H & x_3<x\le x_4 \\ (\varepsilon_1\gamma_0+\gamma_1\varepsilon_0-\varepsilon_0\varepsilon_1\gamma_1)H & x_4<x\le x_5 \\ (\varepsilon_1\gamma_0+\gamma_1\varepsilon_0-\varepsilon_0\varepsilon_1\gamma_1)H-\frac{x-x_S}{x_6-x_S}\cdot & x_5<x\le x_6 \\ ((\varepsilon_1\gamma_0+\gamma_1\varepsilon_0-\varepsilon_0\varepsilon_1\gamma_1)H- & \\ \rho(\varepsilon_1\beta_0+\varepsilon_0\beta_1-\varepsilon_0\varepsilon_1\beta_1)H) & \\ p(\varepsilon_1\beta_0+\varepsilon_0\beta_1-\varepsilon_0\varepsilon_1\beta_1)H & x_6<x\le x_7 \end{cases}$$

wherein:

D: diameter at chamber mouth;

H: diameter at end of chamber;

L: chamber length;

$\varepsilon_0$: topological divergence coefficient with a value of "0";

$\varepsilon_1$: topological convergence coefficient with a value of "1";

$\beta_0$: convergence coefficient; the ratio between the bore diameter ($d_b$) and the diameter at end of chamber (H) (convergent and divergent-convergent case);

$\beta_1$: divergence coefficient; the ratio between the bore diameter ($d_b$) and the diameter at end of chamber (H) (divergent case); $\beta_1$ is greater than $\beta_0$;

$\gamma_0$: expansion coefficient; the ratio between the diameter of the second segment having an increased diameter ($d_{ob}$) and the diameter at end of chamber (H) (convergent and divergent-convergent case);

$\gamma_1$: expansion coefficient; the ratio between the diameter of the second segment having an increased diameter ($d_{ob}$) and the diameter at end of chamber (H) (divergent case); $\gamma_1$ is greater than $\gamma_0$;

$\rho$: choke coefficient; the ratio between the outlet diameter and the bore diameter $\beta_0$ or $\beta_1$.

2. The gun barrel assembly according to claim 1, wherein said second segment having an increased diameter has a constant, divergent or combined configuration.

3. The gun barrel assembly according to claim 1, wherein the internal profile of said barrel assumes a shape defined by the parameters $\varepsilon_0$, $\varepsilon_1$: a profile having a convergent configuration, in which $\chi_1=\chi_2$.

4. The gun barrel assembly according to claim 1, comprising the combination of one or more of three basic components: a barrel body, an extension, an inner choke member, an outer choke member.

5. The gun barrel assembly according to claim 1, wherein said barrel body has a choke provided inside said barrel body; said barrel body having no muzzle thread.

6. The gun barrel assembly according to claim 1, wherein said barrel body has an internal geometric configuration defined by: a length of the chamber/bore conical blending portion, a bore diameter, and a fixed choke length and type.

7. The gun barrel assembly according to claim 1, comprising an inner choke member.

8. The gun barrel assembly according to claim 1, comprising an outer choke member.

9. The gun barrel assembly according to claim 1, comprising an extension and an inner choke member.

10. The gun barrel assembly according to claim 1, comprising an extension and an outer choke member.

11. The gun barrel assembly according to claim 1, having a double configuration, comprising a tube associated with said powder chamber; said powder chamber having a variable length in order to provide different lengths of said gun barrel assembly by using the same tube.

12. The gun barrel assembly according to claim 1, wherein said formula is valid for all smoothbore calibers.

* * * * *